US008425282B2

(12) United States Patent
Woods et al.

(10) Patent No.: US 8,425,282 B2
(45) Date of Patent: Apr. 23, 2013

(54) ACCESSORY FOR POWER TOOL

(75) Inventors: Richard S. Woods, Menomonee Falls, WI (US); Michael D. Allan, Sun Prairie, WI (US); Justin M. Fluegel, Delafield, WI (US)

(73) Assignee: PFERD Inc., Leominster, MA (US)

( * ) Notice: Subject to any disclaimer, the term of this patent is extended or adjusted under 35 U.S.C. 154(b) by 690 days.

(21) Appl. No.: 12/580,110

(22) Filed: Oct. 15, 2009

(65) Prior Publication Data

US 2011/0092144 A1 Apr. 21, 2011

(51) Int. Cl.
*B24B 23/00* (2006.01)

(52) U.S. Cl.
USPC ..... 451/342; 451/359; 451/28

(58) Field of Classification Search ..... 451/28, 451/342, 359, 464, 487, 508, 510
See application file for complete search history.

(56) References Cited

U.S. PATENT DOCUMENTS

| | | | | |
|---|---|---|---|---|
| 922,049 | A | 5/1909 | Sanfason | |
| 2,822,648 | A | 2/1958 | Metzger et al. | |
| 2,912,021 | A | 11/1959 | Gommel | |
| 3,596,415 | A | 8/1971 | Donahue, Jr. | |
| 4,237,581 | A | 12/1980 | Langen et al. | |
| 5,040,341 | A | 8/1991 | Okinaga | |
| 5,303,688 | A * | 4/1994 | Chiuminatta et al. | 125/15 |
| 5,406,669 | A * | 4/1995 | Lesiw | 15/179 |
| 5,477,845 | A * | 12/1995 | Zuzelo | 125/15 |
| 5,538,464 | A | 7/1996 | MacKay, Jr. | |
| 5,895,317 | A | 4/1999 | Timm | |
| 6,093,090 | A * | 7/2000 | Tosto et al. | 451/342 |
| 6,893,335 | B2 | 5/2005 | MacKay | |
| 2012/0066854 | A1 * | 3/2012 | Hettes | 15/180 |

FOREIGN PATENT DOCUMENTS

DE 42 37 581 5/1994

OTHER PUBLICATIONS

International Search Report and Written Opinion for PCT/US2011/052583, mail date Feb. 9, 2012, 7 pages.

* cited by examiner

*Primary Examiner* — Maurina Rachuba
(74) *Attorney, Agent, or Firm* — Foley & Lardner LLP

(57) ABSTRACT

A power tool accessory is adapted to be mounted to a spindle of a power tool having a power tool housing. The power tool accessory includes a hub, a working element, a bolt, and a nut. The hub includes a first surface and a second surface that is opposite to the first surface. The hub further includes an opening extending through the hub. An axis of rotation of the hub is defined through the opening. The working element is connected to the hub. The bolt includes a head having a cross-section that is greater than the opening of the hub. The bolt further includes a shaft adapted to extend through the opening of the hub. The shaft is adapted to be received on the spindle of the power tool. The nut cooperates with the bolt and includes a head and an aperture extending through the head. The head of the nut has a cross-section that is greater than the opening of the hub. The aperture of the nut is adapted to be received on the shaft of the bolt. The bolt and the nut are mounted to the hub such that when the power tool accessory is mounted to the power tool for operation, the position of the hub relative to the power tool housing is substantially the same regardless of whether the first surface or the second surface of the hub is adjacent to the power tool housing.

24 Claims, 4 Drawing Sheets

ACCESSORY FOR POWER TOOL

BACKGROUND

The present invention relates generally to the field of rotary power tools for cutting, grinding, and polishing. More specifically, the present invention relates to an accessory, such as a tool wheel, for use with a rotary power tool.

A grinder is a type of rotary power tool generally used to remove or cut into material. For example, angle grinders are often used to clean surfaces prior to welding and to polish and remove burs from freshly made welds. Grinders operate by rotating an abrasive tool wheel, such as a wire brush, a cup brush, or an abrasive disk. Some angle grinders operate using a wire brush having braids of carbon steel or stainless steel wire emanating radially from a central hub.

SUMMARY

One embodiment of the invention relates to a power tool accessory. The power tool accessory is adapted to be mounted to a spindle of a power tool having a power tool housing. The power tool accessory includes a hub, a working element, a bolt, and a nut. The hub includes a first surface and a second surface that is opposite to the first surface. The hub further includes an opening extending through the hub. An axis of rotation of the hub is defined through the opening. The working element is connected to the hub. The bolt includes a head having a cross-section that is greater than the opening of the hub. The bolt further includes a shaft adapted to extend through the opening of the hub. The shaft is adapted to be received on the spindle of the power tool. The nut cooperates with the bolt and includes a head and an aperture extending through the head. The head of the nut has a cross-section that is greater than the opening of the hub. The aperture of the nut is adapted to be received on the shaft of the bolt. The bolt and the nut are mounted to the hub such that when the power tool accessory is mounted to the power tool for operation, the position of the hub relative to the power tool housing is substantially the same regardless of whether the first surface or the second surface of the hub is adjacent to the power tool housing.

Another embodiment of the invention relates to an accessory for a power tool. The accessory includes a hub having a threaded aperture, a first polygonal surface, and a second polygonal surface. The threaded aperture is in a center of the hub, and a working element is attached to the hub. The threaded aperture is designed to receive a spindle of the power tool. The first polygonal surface projects laterally from a first side of the hub, and the second polygonal surface projects laterally from a second side of the hub. Preferably, each of the polygonal surfaces project approximately the same distance from the hub. The polygonal surfaces and the hub are designed to allow a fastening tool to engage either the first polygonal surface or the second polygonal surface so as to apply a torque for attaching or detaching the hub to or from the spindle. As such, the accessory is designed to allow a user to remove or install the accessory from the power tool from either side of the accessory.

Yet another embodiment of the invention relates to a method of manufacturing an accessory for a power tool, which includes several steps. One step includes providing a wheel having an aperture in a center thereof, and a working element. Another step includes providing a bolt having a threaded aperture therein and a head of the bolt. The threaded aperture is adapted to receive a spindle of the power tool. Yet another step includes providing a nut having a head and forming a sleeve. Another step includes positioning the bolt on a first side of the wheel such that the bolt extends laterally a distance from the first side of the wheel and the threaded port is aligned with the aperture of the wheel. Still another step includes positioning the nut on a second side of the wheel such that the nut extends laterally a distance from the second side of the wheel. The distance that the nut extends from the second side of the wheel is approximately the distance that the bolt extends from the first side of the wheel. Another step includes fastening the bolt to the nut.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Figure 1:
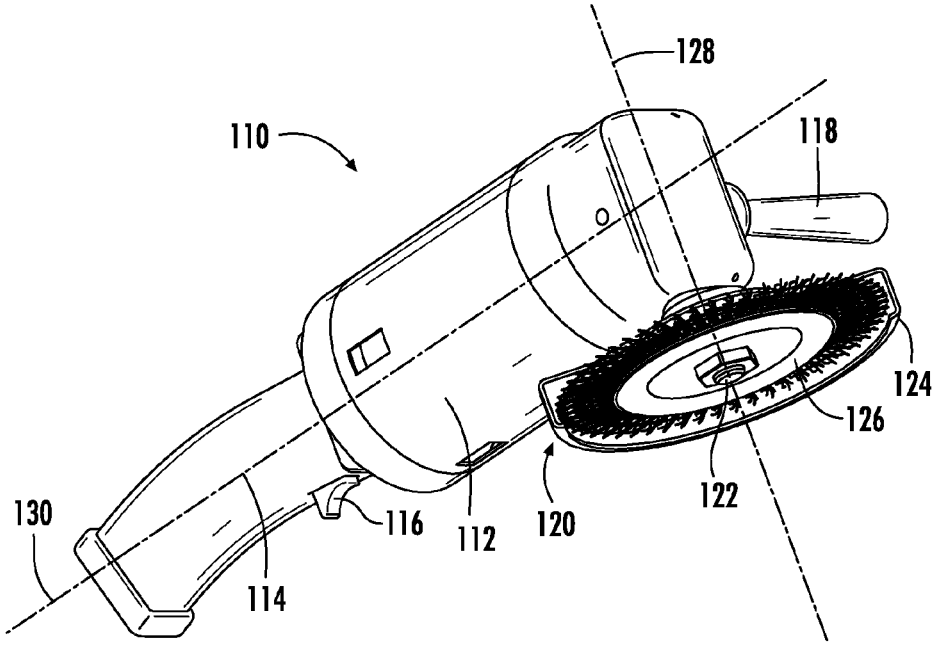
FIG. 1 is a perspective view of a power tool having a tool wheel mounted thereto according to an exemplary embodiment of the invention.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Typically a rotary power tool, such as an angle grinder, has a drive shaft or spindle extending therefrom on which a power tool accessory, such as an abrasive tool wheel, a buffer wheel, a grinding stone, etc. is mounted. For example, the abrasive tool wheel may attach to the angle grinder drive shaft via a threaded hub provided in the center of the tool wheel. The hub includes a female connector (e.g., port, nut, etc.) fastened to and locking into the center of the tool wheel, typically including a head that extends from one side of the tool wheel. A threaded spindle or mandrel of the angle grinder may be screwed into the female connector. When the braided wire or other working element (e.g., sand paper, etc.) of the tool wheel wears out, or when a different type of tool wheel is needed, the tool wheel on the angle grinder may be replaced by unscrewing the hub of the tool wheel from the spindle.

Angle grinders and other such power tools are typically equipped with a protective guard or shield designed to separate the user from the tool wheel. A standard guard for an angle grinder may include a flange or sleeve extending partially around the working element of the tool wheel, positioned between the user and the working element. During use of the angle grinder, the guard or shield can be used to reduce the chance that debris will contact the user, and the user is less likely to inadvertently contact the operating tool wheel.

As disclosed herein, one may increase the usable life of a tool wheel or other accessory by flipping (i.e., detaching, turning over, and re-attaching) the tool wheel on the angle grinder or other such power tool, from time to time. Flipping the tool wheel reverses the direction of wear on the working element of the tool wheel, which may increase the usable life of the working element. For example, steel braids of a brush wheel may warp or bend as a result of constant use in one direction of rotation. Reversing the direction of rotation of the tool wheel may allow the braids to bend back into a straight configuration, similar to the braids of a new brush wheel. However, reversing the direction of rotation of the tool wheel may not be an option if flipping the tool wheel changes the relative position of the working element in relation to the guard, thereby affecting the interaction between the tool wheel and the guard.

According to an exemplary embodiment, an accessory (e.g., tool wheel) may be designed with a hub that extends an equal distance from either side of the tool wheel. Using this structure, flipping the tool wheel does not significantly affect the position of the tool wheel relative to the guard, spindle, or body of the power tool. As such, the tool wheel may be flipped from time to time, thereby reversing the direction of rotation of the tool wheel and potentially increasing the life of the working element. However, in other embodiments, the hub may extend unequal distances from the sides of the tool wheel.

According to another exemplary embodiment, an accessory may be designed to provide a polygonal fastening surface on each side of a hub. The polygonal fastening surface may be hexagonal, square, rectangular or otherwise shaped, to allow a fastening tool, such as wrench, to engage the fastening surface so that the accessory can be attached or detached to or from a power tool from either side of the accessory. This design may allow for versatility with different power tool configurations, and different types of fastening tools (e.g., socket wrench, open-end wrench, pliers, etc.). However, in other embodiments, the accessory may only include a fastening surface on one side of the hub.

Referring to FIG. 1, a handheld angle grinder 110 includes a housing 112, a back handle 114 with a trigger 116, and a side handle 118 extending from the housing 112. Within the housing 112, the angle grinder 110 includes a motor, a gear reduction, a braking mechanism, and a bearing (not shown). Coupled to the motor and gear reduction, the angle grinder 110 further includes a working end 120 having a spindle 122 and a guard 124. A tool wheel, in the form of a brush wheel 126, is selectively attached to the spindle 122 and is partially surrounded by the guard 124. Activation of the motor, such as via the trigger 116, rotates the spindle 122 and the brush wheel 126 mounted thereto about an axis 128 an at an angle (e.g., substantially a right angle) to a longitudinal axis 130 of the angle grinder 110. The bearing within the housing 112 controls side forces experienced by the spindle 122 as the brush wheel 126 is used to grind, clean, polish, etc. a workpiece. In other embodiments, a power tool housing may vary in size and shape from the housing 112.

The motor may be an electric motor powered by any number of conventional power sources, such as battery, via a conventional power cord, a combustion engine (e.g., two-stroke), or a pneumatic motor. The guard 124 may also be adjustable. The angle grinder 110 may include a power cord, or may not include the side handle 118 in some embodiments. The axis 128 of rotation may have any number of alignments relative to the longitudinal axis 130, including parallel alignment. In other embodiments, the power tool employs any number of a variety of accessories or forms of tool wheel, such as a cup brush, an abrasive disk, a cut-off disk, a grinding stone, a polishing pad, a sanding disk, various wire brush configurations, etc. In other embodiments, other types of grinders and other types of power tools are used, such as tile and glass cutters, disk sanders, circular saws, wall chasers, concrete saws, and other power tools.

Figure 2:
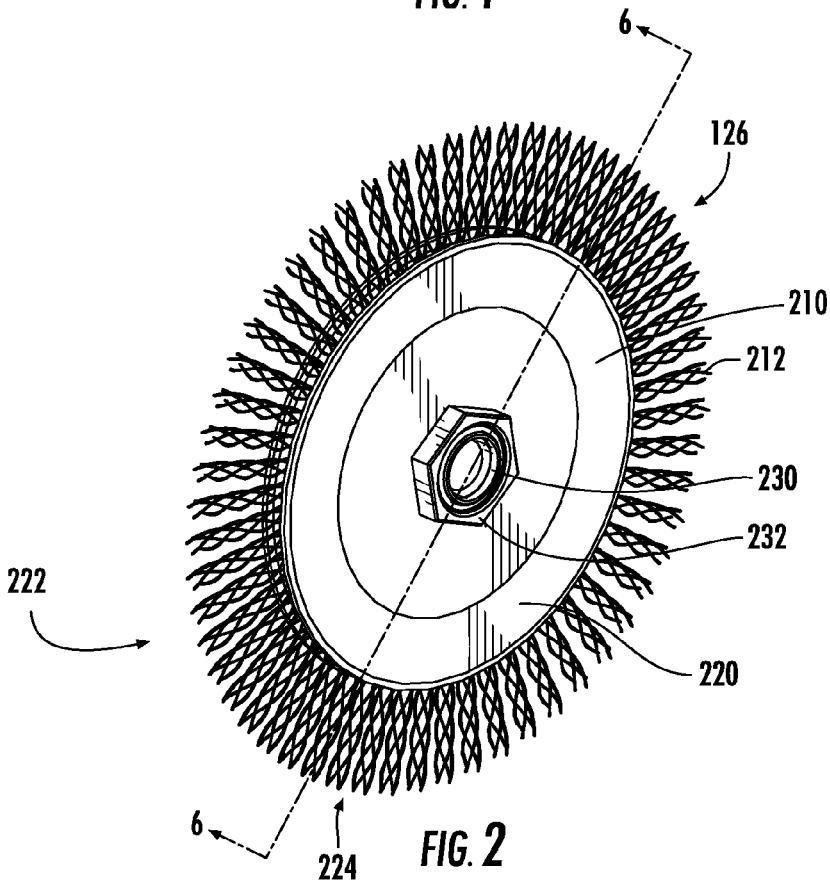
FIG. 2 is a perspective view of a tool wheel according to an exemplary embodiment of the invention.
Figure 3:
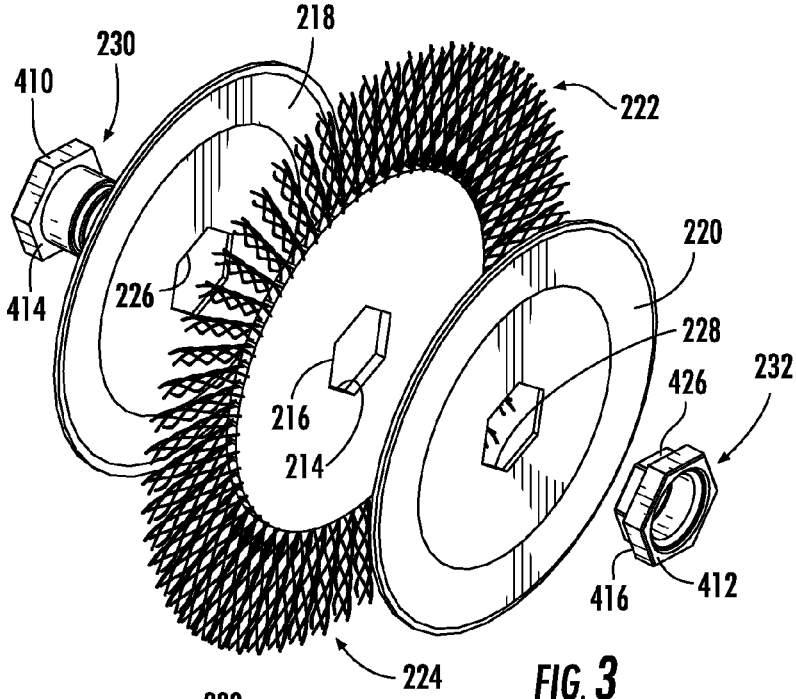
FIG. 3 is an exploded view of the tool wheel of FIG. 2.

Referring to FIGS. 2-3, the brush wheel 126 (i.e., wire brush) includes a hub 210 and steel braids 212 attached to and extending radially outwardly from the hub 210. In the center of the hub 210 (i.e., center of mass), a contoured aperture 214 (e.g., opening, port, hole, etc.) (see FIG. 3) is formed, ideally with a hexagonal periphery 216. In other embodiments, the aperture may have a periphery of a wide variety of shapes, such as a non-circular periphery, a triangular aperture, a square aperture, an oval aperture, etc. The particular shape of the contour is not critical, provided that the contour resists rotation of the brush wheel 126 relative to the spindle (e.g., spindle 122 as shown in FIG. 1).

According to an exemplary embodiment, two opposing support plates 218, 220 (e.g., a first surface, a second surface, etc.) are fastened to opposite sides of the hub 210, one support plate 218 on a first side 222 of the brush wheel 126 and another support plate 220 on a second side 224 of the brush wheel 126. The support plates 218, 220 may orient and secure the steel braids 212 relative to the hub 210 by gripping and guiding ends of the steel braids 212 radially away from the hub 210. Each of the support plates 218, 220 includes an aperture 226, 228 designed to be aligned with the aperture 214 in the center of the hub 210. Ideally, the apertures 226, 228 share the same contour as the aperture 214 of the hub 210. The support plates 218, 220 may be spot welded, projection welded, tig welded, or are otherwise fastened to the hub, such as via threaded fasteners, glue, interlocking parts, pins, and other commercially available fasteners. According to a preferred embodiment, a connector (e.g., nut, bolt, pin, linkage, etc.) may be inserted through the first supporting plate 218, the center hub 210, and the second supporting plate 220. The connector is then swaged on an end that is protruding through the second supporting plate 220, where the swaged connector is the only fastening device used. On some sizes of wheel brushes, the supporting plates are welded as described, then a connector is inserted through the assembly and swaged.

Figure 4:
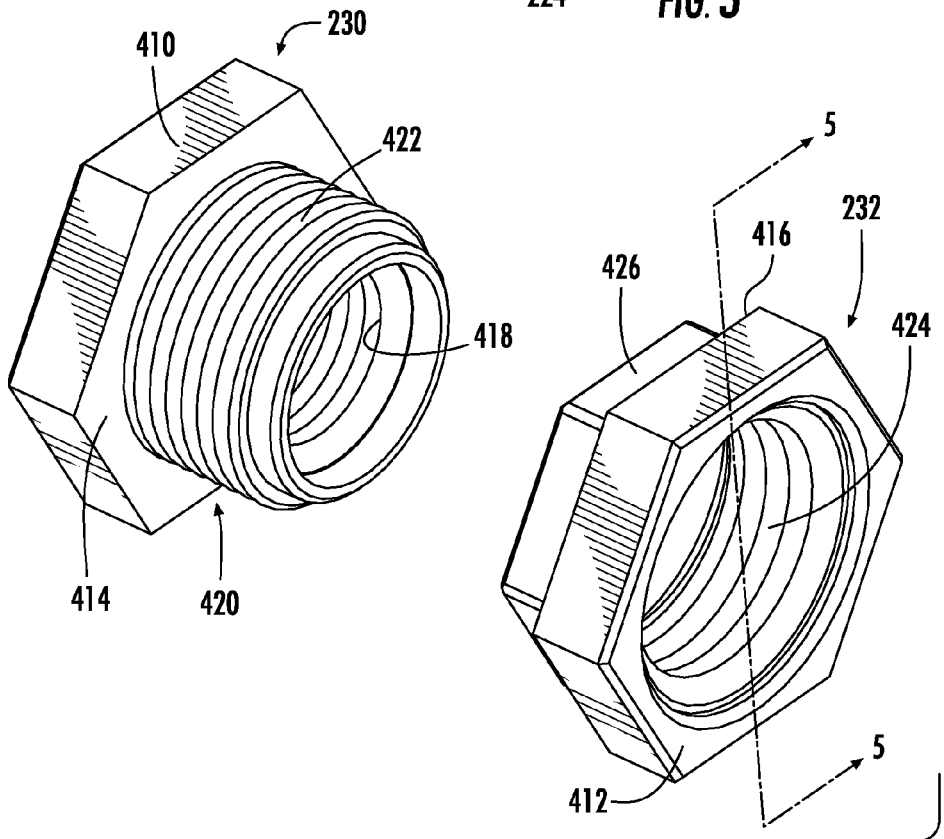
FIG. 4 is a perspective view of a bolt and a nut according to an exemplary embodiment of the invention.
Figure 8:
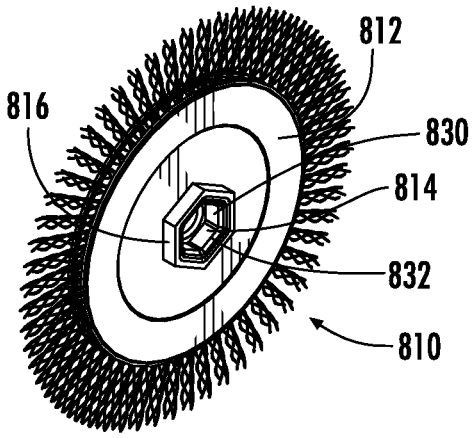
FIG. 8 is a perspective view of a tool wheel according to yet another exemplary embodiment of the invention.

According to another exemplary embodiment, a tool wheel may be designed with a hub assembly formed partially from a bolt and a nut. Referring again to FIGS. 2-3, the brush wheel 126 further includes a nut 232 and a bolt 230 having an aperture formed therein. The bolt 230 has a head (see, e.g., head 410 as shown in FIG. 4) and a male connector in the form of a shaft (see, e.g., shaft 818 as shown in FIG. 8) projecting from the head 410. According to an exemplary embodiment, the bolt 230 may additionally serve as a female connector (e.g., a nut) for coupling to the spindle 122. For example, the bolt may be hollow or have a threaded inner surface, interior cavity, aperture, etc. within or through the head or the shaft. A spindle of a power tool may be inserted into the aperture of the bolt, such as by screwing the cooperating threads on the spindle into the threaded inner surface or by latching or pinning the spindle through the aperture. The nut 232 may serve as a backing for receiving the bolt 230, with the female connector of the bolt 230 serving as a nut within or coupled to the female connector of the nut 232. In some embodiments the nut 232 is threaded, and in other embodiments the nut 232 is not threaded.

Referring to FIGS. 3-4, the bolt 230 and the nut 232 may be formed from any number of conventional materials including, but not limited to steel, iron, aluminum alloy, zinc alloy, or other materials, and may be cold-headed with a female connector port separately drilled and tapped, or produced from any number of conventional manufacturing processes, including but not limited to screw machined, die cast, sintered from powdered metal, plastic injection molded, or otherwise manufactured. The bolt 230 and the nut 232 each include a head 410, 412 and a shoulder 414, 416, respectively. A portion of at least one of the bolt 230 and the nut 232 extends through the apertures 226, 228 in the support plates 218, 220 and the aperture 214 in the center of the hub 210 of the brush wheel 126. Preferably, portions of both the bolt 230 and nut 232 extend through the aperture 214 and engage each other. The shoulders 414, 416 are wider (e.g., along a portion of a cross-section) than the apertures 226, 228 in the support plates 218, 220, allowing the shoulders 414, 416 abut the outer surfaces 234, 236 of the support plates 218, 220. The bolt 230 may be inserted into the nut 232, and fastened to the nut 232 such as via intermeshing of cooperating threading. With the bolt 230 and the nut 232 fastened together, the shoulders 414, 416 hold the support plates 218, 220 against the hub 210 of the brush wheel 126. While the inclusion of support plates 218 and 220 are desired, they are not required.

The heads 410, 412 of the bolt 230 and the nut 232 are designed to be compatible with a wrench, a socket wrench, a ratchet, or another such tool. According to an exemplary embodiment, the heads 410, 412 include side surfaces that are parallel to each other. In some embodiments, the heads 410, 412 are hexagonal (i.e., hex), square, rectangular, or otherwise contoured. In still other embodiments, customized tooling may be used to move the heads (e.g., triangularly-slotted wrench).

Still referring to FIGS. 3-4, the nut 232 includes a retainer portion 426 (e.g., a shoulder, a male connector, etc.) extending therefrom that may be inserted into the aperture 214 of the wheel hub 210. According to an exemplary embodiment, the retainer portion 426 is complementary to the shape of the periphery 216 of the aperture 214, such that the retainer portion 426 fits tightly into the contoured aperture 214. The complementary shape of the periphery 216 of the aperture 214 and the retainer portion 426 limits or prevents relative rotation between the spindle 122, the wheel hub 210 and the nut 232 (e.g. and between the brush wheel 126 and the spindle 122). In other embodiments, the shape of the retainer portion 426 does not identically match the periphery of the aperture 214, but is keyed or splined to prevent relative rotation between the nut 232 and the wheel hub 210. In some embodiments, the retainer portion 426 is integrally formed with the nut 232. In other embodiments, the retainer portion 426 is integrally formed with the bolt 230.

Figure 5:
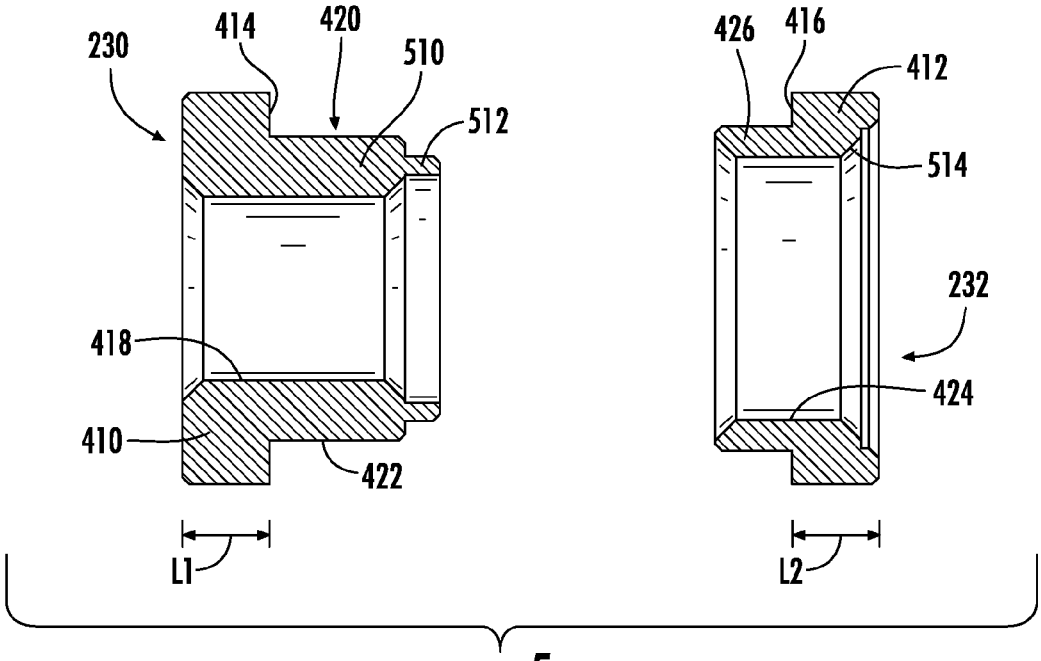
FIG. 5 is a cross-sectional view of the bolt and the nut taken along line 5-5 of FIG. 4.

Referring now to FIGS. 4-5, the bolt 230 and the nut 232 are sized and configured to be coupled together. The bolt 230 functions as a female coupling (e.g., port) with regard to the spindle of the rotary power tool (see, e.g., spindle 122 as shown in FIG. 1), in that the bolt 230 includes an internally threaded aperture 418 through the center of the bolt 230. The spindle of the rotary power tool may be screwed into the threaded aperture 418 thereby fastening the bolt 230 to the spindle.

According to an exemplary embodiment, the bolt 230 functions as a male coupling (e.g., bolt or screw) with regard to the nut 232. As such, the bolt 230 includes a male connector 420 (e.g., male end, shaft, etc.) that extends away from the head 410 and the shoulder 414. The male connector 420 of the bolt 230 may include a threaded outer surface 422 (e.g., exterior surface). Accordingly, with regard to the bolt 230, the nut 232 functions as a cooperating female coupling (e.g., nut). In some embodiments, the nut 232 includes a threaded sleeve 424 or aperture adopted to receive and cooperate with the threaded outer surface 422 of the male connector 420 of the bolt 230.

In some embodiments, neither the outer surface 422 of the male connector 420 of the bolt 230 nor the sleeve 424 in the nut 232 are threaded. For example, in other embodiments, the exterior surface of the bolt includes a series of extensions in the form of ramps or hooks extending annularly around the exterior surface. The ramps or hooks are designed to slide past oppositely oriented ramps or hooks within the port of the nut such that the ramps on the bolt and nut engage each other (e.g., catch, interlock, etc.) and lock the bolt within the nut.

Referring to FIG. 5, the bolt 230 includes the threaded aperture 418, the threaded outer surface 422, and a core 510 between the aperture 418 and the outer surface 422. According to an exemplary embodiment, the core 510 is a solid, continuous metal. A shoulder 512 of the core 510 extends axially outwardly from the male connector 420 of the bolt 230, beyond the threading. Accordingly, the nut 232 includes a complementary bevel 514 or recessed portion inside the sleeve 424, proximate to the head 412 of the nut 232. When the male connector 420 of the bolt 230 is fully inserted into the sleeve 424 of the nut 232, the shoulder 512 of the core 510 may be swedged (i.e., flared, bent, twisted, plastically deformed, etc.) forming a flange 610 (see FIG. 6) that engages (e.g., catches, locks onto, etc.) a surface of the nut 232, thereby securing the bolt and the nut together. For example, the flange 610 may fill the bevel 514. The flange 610 engages the bevel 514 and permanently fastens (i.e., in a manner not designed to be readily unfastened) the bolt 230 and the nut 232 together. In other embodiments, the bolt 230 and the nut 232 are otherwise permanently fastened together via conventional processes, such as welding, gluing, etc. In some embodiments, the bolt 230 and the nut 232 are designed to be unfastened or removably interconnected from each other and from the tool wheel.

Still referring to FIG. 5, the heads 410, 412 of the bolt 230 and the nut 232 have approximately the same thicknesses L1, L2 (e.g., height, distance, etc.). For example, the thicknesses L1, L2 may be less than an inch, preferably less than a half inch, such as about a quarter inch. The heads 410, 412 serve as limits or backstops, such that the thicknesses L1, L2 of the heads 410, 412 limit the position of the tool wheel on the spindle of the power tool. Accordingly, the thicknesses L1, L2 may be designed in relation to the structure of the guard, to position the wheel within the guard (see, e.g., guard 124 as shown in FIG. 1). In other embodiments, spacers, such as washers, glue-on extensions, or other bodies may be used to increase or decrease the thicknesses L1, L2 piecemeal, such that L1 and L2 are approximately the same distances.

Heads 410, 412 of approximately the same thicknesses L1, L2 allow of the tool wheel to be flipped on the spindle, without materially altering the relative position of the working element to the power tool. For example, a tool wheel, such as the wheel brush 126, with the heads 410, 412 of the bolt 230 and nut 232 being approximately the same thickness L1, L2 may be fastened in the same position relative to the guard 124 of the angle grinder 110 (see FIG. 1) regardless of which side of the wheel brush 126 is adjacent to the working end 120. For example, if the steel braids 212 of the brush wheel 126 become bent or worn due to continuous use, rotating in a first direction, then the brush wheel 126 may be removed from the spindle 122, flipped over, and re-installed on the spindle 122. The brush wheel 126 will then rotate to push the steel braids 212 back to their original orientation (e.g., extending radially away from the hub 210). As such, the brush wheel 126 may have a longer usable life than if the brush wheel 126 were used only in one direction of rotation. Further, interaction between the guard 124 of the grinder 110 (or other such guard or powered tool) and the brush wheel 126 will not be affected by flipping the brush wheel 126. Additionally, the threaded sleeve 424 (e.g., fitting) allows for use of a wrench to install or remove the brush wheel 126 (or other accessory) from a grinder (or other tool) from either side of the brush wheel 126.

According to an exemplary embodiment, a fastening tool may be able to engage (e.g., grip) the bolt 230 and the nut 232, which are projecting from opposite sides of the tool wheel or other accessory. The heads include a polygonal contour (e.g., periphery, shape, exterior, etc.), which is designed to be engaged by the fastening tool. Spacing and thicknesses L1, L2 of the heads 410, 412 allows for the fastening tool to be inserted between the accessory and the powered tool, to reach the heads 410, 412. Some exemplary fastening tools include commercially-available gripping pliers, and preferably wrenches, such as open-end wrenches (i.e., spanners), box-end wrenches, tube wrenches, adjustable wrenches, socket wrenches, crowfoot wrenches, Allen, Bristol, or Torx wrenches, alligator wrenches, tap wrenches, etc.

Figure 6:
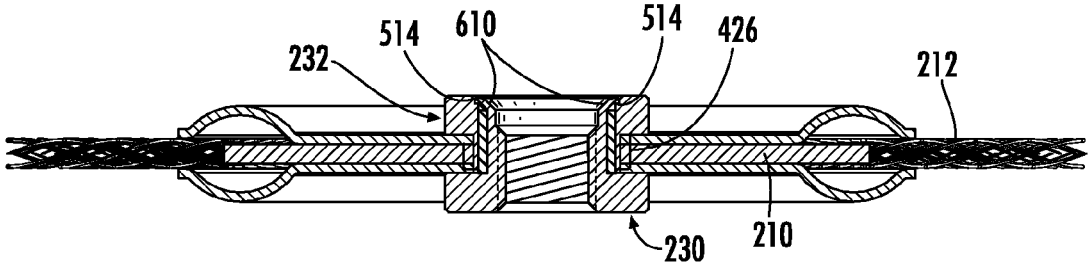
FIG. 6 is a cross-sectional view of the tool wheel taken along line 6-6 of FIG. 2.

FIG. 6 is a cross-sectional view of the tool wheel showing the bolt 230 and the nut 232 of the brush wheel 126 coupled together through an aperture in the center of the hub 210. According to an exemplary embodiment, one method of manufacturing a tool wheel for a power tool, includes providing the wheel hub 210, the working element (e.g., portion of the tool designed to interact with the workpiece, etc., such as steel braids 212, abrasive surface, buffering surface, etc.), the bolt 230, and the nut 232. In some embodiments, where the nut 232 includes the retainer portion 426, the nut 232 is positioned on a first side of the hub 210 with the retainer portion 426 of the nut 232 inserted through the aperture. A shoulder of the nut 232 is positioned upon a first side of the wheel hub 210 (e.g., support plate), and the retainer portion 426 tightly fits within the aperture. The bolt 230 is attached to the nut 232 with the male connector 420 of the bolt 230 screwed into a sleeve of the nut 232. A shoulder of the bolt 230 is positioned upon a second side of the wheel hub 210. Heads of the bolt 230 and nut 232 both extend about the same distance (e.g., thicknesses L1, L2 as shown in FIG. 5) from the wheel hub 210. Further, a portion 610 of the bolt 230 extending through the nut 232 is swedged to the bevel 514, permanently fastening the bolt 230 to the nut 232.

Figure 7:
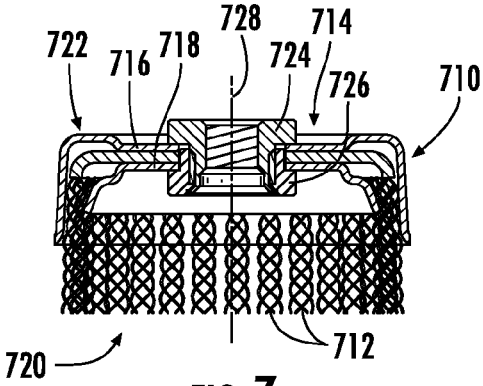
FIG. 7 is a cross-sectional view of a second tool wheel according to another exemplary embodiment of the invention.

Referring to FIG. 7, the method steps described with regard to FIG. 6, similarly may be used to manufacture a cup brush 710, or other tool wheel. The cup brush 710 may be fastened to a spindle of a rotary power tool, such as the angle grinder 110. The cup brush 710 includes steel braids 712 extending from a hub 714 of the cup brush 710, with support cups 716, 718 spot welded, or otherwise fastened to the hub 714. Unlike the steel braids 212 of the brush wheel 126, the braids 712 of the cup brush 710 extend in a direction approximately parallel to an axis of rotation 728 of the cup brush 710. As such, the cup brush 710 has a first side 720 having the tool surface and a second side 722 through which the spindle may be fastened. A bolt 724 and a nut 726 may be attached to the hub 714 of the cup brush 710, with either the bolt 724 or the nut 726 extending from the first side 720 of the cup brush 710 and the other extending from the second side 722. According to a preferred embodiment, a connector (e.g., nut, bolt, pin, linkage, hook, etc.) may be inserted through the first support cup 716, the center hub 714, and the second support cup 718. The connector is then swaged on an end that is protruding through the second support cup 718, where the swaged connector is the only fastening device used. On some sizes of cup brushes, the support cups are welded and then a connector is inserted through the assembly and swaged. Additionally, a threaded fitting through the bolt (see, e.g., threaded sleeve 424 as shown in FIG. 4) allows for use of a socket wrench to install or remove the accessory from the open side of a grinder.

A significant advantage of at least one embodiment is that a fastening tool may be able to engage (e.g., grip) the bolt 724 and the nut 726, which are projecting from opposite sides of the hub 714. This provides an important and unique advantage. An accessory tool having gripping surfaces (e.g., fastening surfaces) provided on both sides of the hub makes the accessory tool far more versatile, adapted for use on a larger selection of power tools used in a wider variety of applications. According to an exemplary embodiment, the bolt 724 and the nut 726 each include a polygonal head (e.g., periphery, shape, exterior, etc.), which is designed to be engaged by the fastening tool. Spacing and thicknesses of the heads allow for the fastening tool to be inserted between the cup brush 710 and the powered tool, to reach the heads. Also a conventional wrench, such as a socket wrench, may be extended into the cup, to engage one of the heads for fastening or unfastening the cup brush 710 and spindle. Some exemplary fastening tools include commercially-available gripping pliers, and preferably wrenches, such as open-end wrenches (i.e., spanners), box-end wrenches, tube wrenches, adjustable wrenches, socket wrenches, crowfoot wrenches, Allen, Bristol, or Torx wrenches, alligator wrenches, tap wrenches, etc.

Figure 9:
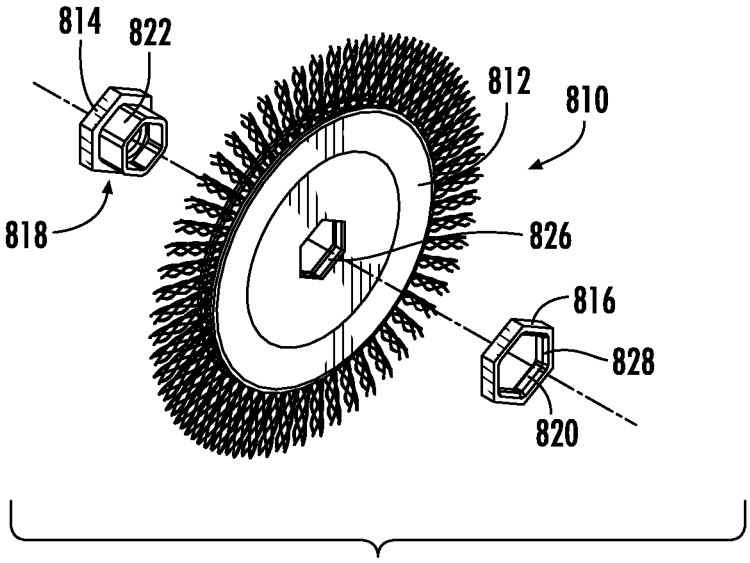
FIG. 9 is an exploded view of the tool wheel of FIG. 8.

Referring to FIGS. 8-9, a tool wheel 810 includes a hub 812 having a bolt 814 and a nut 816. The bolt 814 includes a shaft 818 used to attach to a sleeve 820 in the nut 816. The exterior surface 822 of the shaft 818 is hexagonal. The hexagonal exterior surface 822 cooperates with a complementary aperture 826 of the wheel hub 812. The sleeve 820 in the nut 816 also includes a hexagonal periphery 828. To manufacture the tool wheel 810, the male connector 818 of the bolt 814 may be inserted through the aperture 826 in the hub 812 and into the sleeve 820 of the nut 816. An end portion 830 of the bolt 814 may then be swedged to form a flange 832, locking the bolt 814 and the nut 816 together through the hub 812. In some embodiments the spindle of the power tool may include a hexagonal shaft that fits into the sleeve 820 in the bolt 814, and may be locked in place via a latch, a clip, a pin, or another form of fastener. In still other embodiments, an additional sleeve with threading may be permanently inserted into or formed within the sleeve 820 of the bolt 814, within which a threaded spindle may be fastened.

According to an exemplary embodiment, a tool wheel for a power tool, includes a hub, a bolt, and a nut. The hub has an aperture in a center thereof and a working element coupled thereto. The bolt has a shaft and a threaded aperture therein. The threaded aperture is adapted to receive a spindle of the power tool. The nut is forming a sleeve. The shaft of the bolt is extending through the aperture of the hub and is received within the sleeve of the nut. The bolt is projecting laterally from a first side of the hub, the nut is projecting laterally from a second side of the hub. The bolt and the nut are each projecting approximately the same distance away from the hub. In addition to the above-described features in this paragraph, in another embodiment the bolt and the nut are permanently fastened together through the aperture of the hub. In addition to the above-described features in this paragraph, in yet another embodiment an end of the bolt has been swedged to form a flange contacting a surface of the nut, such that the bolt and the nut are fastened together. In addition to the above-described features in this paragraph, in still another embodiment the aperture of the hub has a non-circular periphery, and the bolt further includes a shoulder sized and contoured to fit within the aperture of the hub to limit rotation of the nut relative to the hub. In addition to the above-described features in this paragraph, in another embodiment the non-circular periphery is hexagonal. In addition to the above-described features in this paragraph, in yet another embodiment the bolt includes a threaded outer surface and the sleeve includes a threaded inner surface, and the bolt is screwed into the sleeve. In addition to the above-described features in this paragraph, in yet another embodiment the tool wheel is at least one of a brush wheel, an abrasive disk, or an cup brush, and the power tool is a grinder. In addition to the above-described features for the first embodiment described in this paragraph, in another embodiment the aperture of the hub has a non-circular periphery, and the nut further includes a shoulder sized and contoured to fit within the aperture of the hub to limit rotation of the nut relative to the hub.

The construction and arrangements of the power tool, tool wheel, and hub, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, configurations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A power tool accessory adapted to be mounted to a spindle of a power tool having a power tool housing, the power tool accessory comprising:

a hub comprising:

a first surface and a second surface opposite to the first surface, an opening extending therethrough, and defining an axis of rotation of the hub through the opening, and a working element connected to the hub;

a bolt comprising:

a head having a cross-section greater than the opening of the hub, and a shaft adapted to extend through the opening of the hub, wherein the shaft is adapted to be received on the spindle of the power tool;

a nut cooperating with the bolt, the nut comprising:

a head having a cross-section greater than the opening of the hub, and an aperture extending through the head of the nut, wherein the nut is adapted to be received on the shaft of the bolt;

the bolt and the nut mounted to the hub such that when the power tool accessory is mounted to the power tool for operation, the position of the hub relative to the power tool housing is substantially the same regardless of whether the first surface or the second surface of the hub is adjacent to the power tool housing.

2. The power tool accessory of claim 1, further comprising a shoulder extending from at least one of the head of the bolt or the head of the nut, wherein the opening in the hub is contoured in a shape substantially complementary to the shoulder, whereby relative rotation between the hub and the shoulder is restricted.

3. The power tool accessory of claim 2, wherein the shaft of the bolt has an aperture therein, the aperture adapted to receive the spindle.

4. The power tool accessory of claim 3, wherein the distance that the head of the nut extends from the hub is approximately the distance that the head of the bolt extends from the hub.

5. The power tool accessory of claim 4, wherein the bolt and the nut are permanently fastened together through the aperture of the hub.

6. The power tool accessory of claim 4, wherein an end of the bolt has been swedged to form a flange catching a surface of the nut, thereby fastening the bolt and the nut to one another.

7. The power tool accessory of claim 6, wherein an outer surface of the bolt is threaded and the nut is cooperatively threaded, the bolt being screwed into the nut.

8. The power tool accessory of claim 7, wherein the head of the bolt is substantially hexagonal in cross-section and the head of the nut is substantially hexagonal in cross-section.

9. An accessory for a power tool, comprising:

a hub assembly having a threaded aperture in a center thereof and a working element coupled thereto, the threaded aperture adapted to receive a spindle of the power tool;

wherein the hub assembly further comprises:

a first polygonal surface projecting laterally from a first side of the hub assembly, and a second polygonal surface projecting laterally from a second side of the hub assembly;

the polygonal surfaces and the hub assembly adapted to allow a fastening tool to engage either the first polygonal surface or the second polygonal surface so as to apply a torque for attaching or detaching the hub assembly to or from the spindle, so that a user may remove or install the accessory from the power tool from either side of the accessory.

10. The accessory of claim 9, wherein each of the polygonal surfaces project approximately the same distance from the hub assembly.

11. The accessory of claim 10, wherein the first polygonal surface is a head of a nut and the second polygonal surface is a head of a bolt.

12. The accessory of claim 11, wherein the nut and the bolt are permanently fastened together within the hub.

13. The accessory of claim 12, wherein an end of the bolt has been swedged to form a flange contacting a surface of the nut, whereby the bolt and the nut are fastened together.

14. The accessory of claim 13, wherein the polygonal surfaces are hexagonal.

15. The accessory of claim 14, wherein the accessory is at least one of a brush wheel, an abrasive disk, or an cup brush, and wherein the power tool is a grinder.

16. The accessory of claim 15, wherein the fastening tool is at least one of a wrench or pliers.

17. A method of manufacturing an accessory for a power tool, comprising:

providing a wheel having an aperture in a center thereof, and a working element;

providing a bolt having a threaded aperture therein and a head of the bolt, the threaded aperture adapted to receive a spindle of the power tool;

providing a nut having a head of the nut and forming a sleeve;

positioning the bolt on a first side of the wheel such that the bolt extends laterally a distance from the first side of the wheel and the threaded port is aligned with the aperture of the wheel;

positioning the nut on a second side of the wheel such that the nut extends laterally a distance from the second side of the wheel, wherein the distance that the nut extends from the second side of the wheel is approximately the distance that the bolt extends from the first side of the wheel; and fastening the bolt to the nut.

18. The method of claim 17, wherein the step of fastening the bolt to the nut further comprises screwing the bolt and the nut together.

19. The method of claim 17, wherein the step fastening the bolt to the nut further comprises swedging an end of the bolt to produce a flange positioned to engage a bevel of the nut, locking the bolt and the nut together.

20. The method of claim 17, wherein the step of positioning the nut further comprises positioning a shoulder of the nut into the aperture, the shoulder sized and contoured to tightly fit into the aperture of the wheel, limiting rotation of the nut relative to the wheel.

21. The accessory of claim 11, wherein an end of the bolt has been swedged to form a flange contacting a surface of the nut, whereby the bolt and the nut are fastened together.

22. The accessory of claim 9, wherein the polygonal surfaces are hexagonal.

23. The accessory of claim 9, wherein the accessory is at least one of a brush wheel, an abrasive disk, or a cup brush, and wherein the power tool is a grinder.

24. The accessory of claim 9, wherein the fastening tool is at least one of a wrench or pliers.

* * * * *